US005692294A

United States Patent [19]

Casey

[11] Patent Number: 5,692,294

[45] Date of Patent: Dec. 2, 1997

[54] TOOLS FOR CRIMPING AN ELECTRICAL CONTACT ONTO A CONDUCTOR

[75] Inventor: Daniel Thomas Casey, Harrisburg, Pa.

[73] Assignee: The Whitaker Corporation, Wilmington, Del.

[21] Appl. No.: 565,543

[22] Filed: Nov. 30, 1995

Related U.S. Application Data

[63] Continuation-in-part of Ser. No. 488,922, Jun. 9, 1995, Pat. No. 5,625,942.

[51] Int. Cl.[6] ..... H01R 43/048

[52] U.S. Cl. ..... 29/753; 29/751; 29/863; 72/409.14; 72/416; 72/712

[58] Field of Search ..... 29/33 M, 751, 29/753, 758, 761, 861, 863; 72/409.06, 409.14, 416, 453.16, 712; 7/100

[56] References Cited

U.S. PATENT DOCUMENTS

| | | | |
|---|---|---|---|
| 2,965,147 | 12/1960 | Hoffman | 29/753 X |
| 3,146,519 | 9/1964 | Redwine | 72/416 X |
| 3,871,071 | 3/1975 | Luongo | 29/863 |
| 4,828,516 | 5/1989 | Shaffer | 29/863 |
| 4,890,384 | 1/1990 | Shaffer | 29/863 |
| 4,934,172 | 6/1990 | Bush et al. | 29/751 X |
| 5,084,963 | 2/1992 | Murray et al. | 72/416 X |
| 5,105,095 | 4/1992 | Rudy, Jr. et al. | 307/17 |

FOREIGN PATENT DOCUMENTS

| | | | |
|---|---|---|---|
| 82478 | 3/1990 | Japan | 29/863 |

*Primary Examiner*—Peter Vo

[57] ABSTRACT

Crimping tooling is disclosed for providing a precision crimped termination (182, 186). The tooling includes a crimping die (92) and mating crimping anvil (136) that will operate in a hand operated tool (50), a power assist hand tool, an applicator in a press, or other machine. The crimping die (92) and crimping anvil (136) each have two spaced barrel engaging portions (116, 118, 164, 166) that form four radially arranged precision indents in the barrel of a plated contact terminal (66) for terminating the contact terminal to an electrical conductor (68). Each of the four barrel engaging portions (116, 118, 164, 166) has an arcuate convex shape without any flat surfaces or sharp corners or edges that could interfere with smooth deformation of the barrel without over stressing the plating during crimping. The end (156) of the anvil terminates at each side wall (158, 160) in somewhat sharp edges (168, 170), respectively, that curve outwardly to help prevent the formation of a burr on the crimped connection. The side walls (120, 122) of the opening (110) in the crimping die (92) are tapered at an angle to the axis (102) of the die that is less than three degrees to further protect against the formation of a burr.

20 Claims, 6 Drawing Sheets

TOOLS FOR CRIMPING AN ELECTRICAL CONTACT ONTO A CONDUCTOR

RELATED APPLICATION INFORMATION

This is a Continuation-in-Part of U.S. patent application Ser. No. 08/488,922 filed Jun. 9, 1995 now U.S. Pat. No. 5,625,942.

FIELD OF THE INVENTION

The present invention relates to crimping tools for the precision crimping of electrical contacts onto conductors and more particularly to such tools having improved features that produce a superior crimped termination.

BACKGROUND OF THE INVENTION

Precision crimped contact terminals are typically used in military applications requiring high reliability but are also used in certain other industries. In these applications it is important that the crimped contact terminal be able to be inserted into its housing during field assembly without undo interference and without damage to the contact or its housing. Therefore, the crimping process must be controlled so that deformation of the contact is maintained within acceptable limits and that burrs, sharp edges, and other anomalies are not present. To produce such precision crimps the industry utilizes the so called 4/8 indent crimp. The crimping device consists of four crimping bars spaced 90 degrees apart in a common plane so that there are two sets of opposed crimping bars directed toward a single center. Each crimping bar includes two spaced indentors arranged one above the other in alignment with the longitudinal axis of the terminal. The contact terminal is precisely positioned at the center so that when the crimping takes place, the four crimping bars simultaneously engage the barrel of the contact terminal, forming two sets of four indentations in the barrel which deform the barrel and conductor thereby forming the crimped connection. The tooling for making such a crimp is expensive and does not necessarily always produce a high quality electrical connection. This tooling allows the barrel material between the indentors to extrude outwardly somewhat resulting in an uncontrolled and uneven outer surface which may exceed permissible tolerances. In an effort to overcome this problem and to provide a more cost effective precision crimping apparatus, crimping tooling was developed that provided four crimping indentation in the barrel of the contact terminal, with the forces of the indentors being applied obliquely rather that radially, as was done with the 4/8 indent apparatus. This allowed the use of just two crimping bars instead of four, which could be operated with a standard single linear direction crimping apparatus, such as a hand tool or automated machine. The two crimping bars control the flow of material by confining the barrel and forcing the material to flow inwardly, instead of outwardly as in the 4/8 indent apparatus, thereby providing a more even distribution of the contact material.

An example of such crimping tooling is disclosed in U.S. Pat. No. 4,828,516 which issued May 9, 1989 to Shaffer, which is incorporated herein by reference. The crimping tooling disclosed in the '516 patent, as best seen in FIGS. 1, 2, and 3, includes a crimping die 10 and a mating crimping anvil 12 that are mutually movable toward each other into crimping engagement along the axis 14. The crimping die 10 includes an opening 16 having two opposite side walls 18 and a floor 20. A relief recess 22 is formed in the floor 20 with a pair of barrel engaging portions 24 on each side thereof. The crimping anvil 12 includes two side walls 26, an end 28, a relief recess 30, and a pair of barrel engaging portions 24 on each side thereof. The two side walls 26 are parallel to the axis 14 while each of the side walls 18 diverges from the axis 14 at an angle 32 that is between 5 and 10 degrees. The barrel engaging portions 24 are flat surfaces arranged at a 45 degree angle to the axis 14, the ends of the flat surfaces terminating in small radiuses 34.

As shown in FIG. 2, the barrel 36 of a contact terminal is positioned between the crimping die and anvil preparatory to crimping. As the crimping die and anvil are moved toward partial crimping engagement, as shown in FIG. 3, the flat surfaces 24 and their small radiused portions 34 force the upper and lower portions of the barrel toward each other causing the right and left sides of the barrel 36 to bulge outwardly against the side walls 18. As the material of the barrel is pushed inwardly by the flat surfaces 24, the material must flow and extrude somewhat along the flat surfaces and around the radiused portions 34. Because the radiused portions 34 are relatively small and sharp, as the material is forced around them, cracks sometimes form in the plating. Additionally, because of the relatively large angle 32, there is substantial clearance between the walls 18 and 26 near the end 28 when the two crimping members are not yet fully mated, as shown in FIG. 3. As the barrel 36 is forced against the walls 18, a portion of the material of the barrel wedges into this clearance area, as shown at 38 in FIG. 3, causing a burr. This burr sometimes will remain attached to the crimped barrel even after the crimping die and anvil have fully mated. Additionally, as the burr is wedged between the angled wall 18, it causes unusually high forces within the crimping die which may damage the tooling.

What is needed is crimping tooling that provides a precision four indentation crimp in the barrel of the contact terminal, with the forces of the indentors being applied obliquely rather that radially, without damage to the plating on the outer surface of the barrel and without creating a significant burr on the final crimped terminal.

SUMMARY OF THE INVENTION

A crimping apparatus is disclosed for crimping a contact terminal having a wire receiving barrel to an electrical conductor within the barrel to produce a precision electrical termination. A crimping die is provided having a first pair of barrel engaging portions spaced a fixed distance apart. Additionally, a crimping anvil is provided having a second pair of barrel engaging portions spaced a fixed distance apart, each of which is opposed to and in alignment with a respective one of the barrel engaging portions of the first pair. One of the crimping die and the crimping anvil is arranged to move in a first direction along an axis toward the other and into mated engagement therewith. When a contact terminal is disposed between the crimping die and the crimping anvil the first and second pairs of barrel engaging portions engage the barrel of the contact terminal at four angularly spaced locations forming four indents thereby effecting the electrical termination. Each of the barrel engaging portions includes only a smooth convex surface that engages the barrel during the crimping operation.

DESCRIPTION OF THE PREFERRED EMBODIMENT

Figure 4:
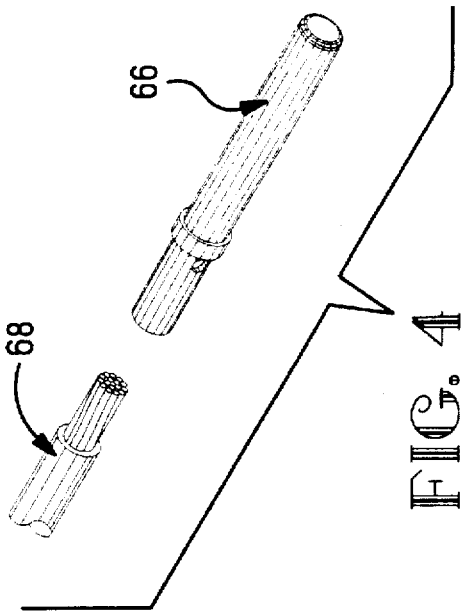
FIG. 4 is an isometric view of a precision contact terminal and a stripped electrical conductor of the type that is crimped by the crimping apparatus of the present invention.
Figure 5:
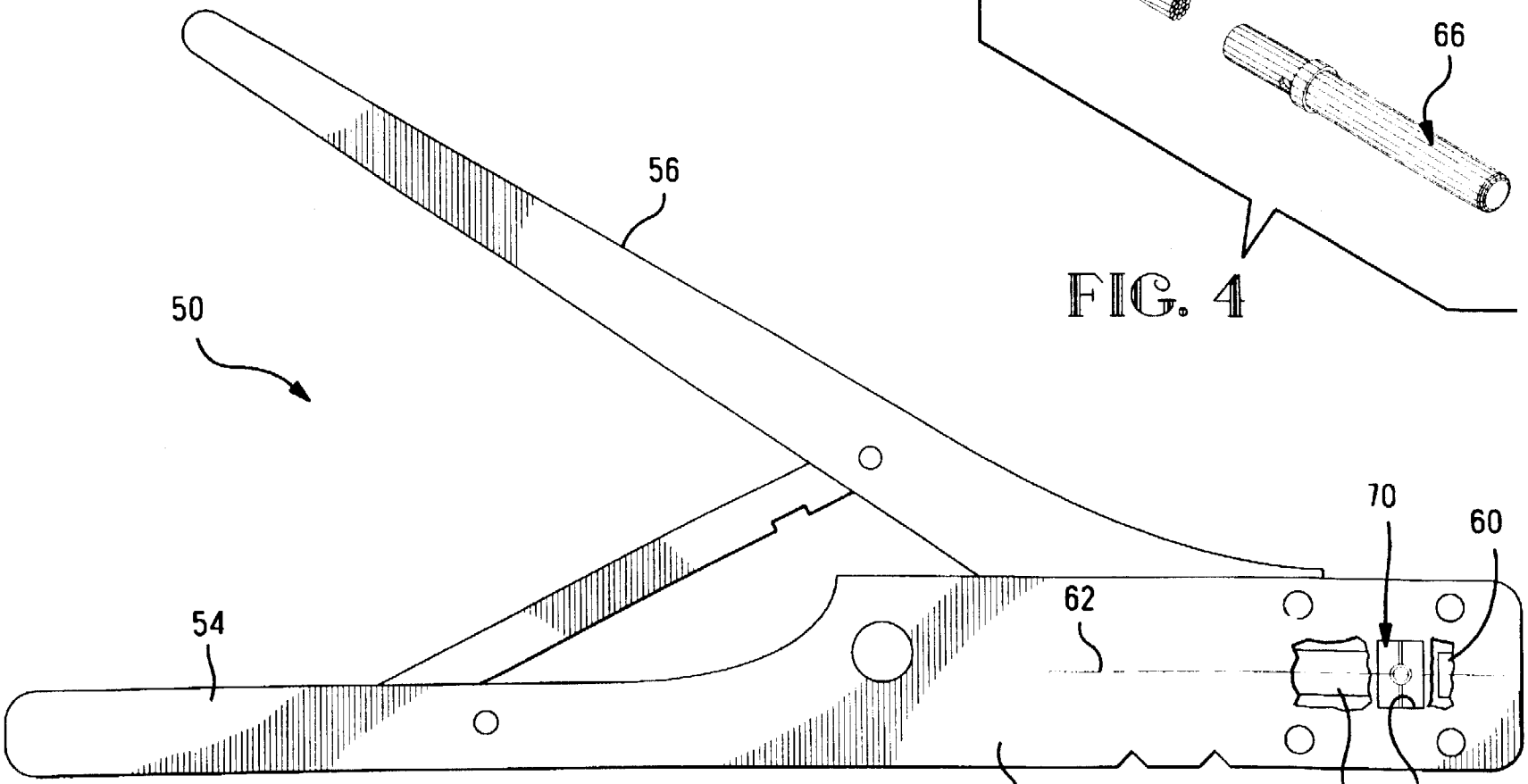
FIG. 5 is a plan view of a hand crimping tool having a crimping mechanism incorporating the teachings of the present invention.

There is shown in FIG. 5 a hand tool 50 having a frame 52, a handle 54 extending from the frame, and an actuating lever 56. The actuating lever is coupled to a ram 58 for moving the ram along a ram axis 62 toward and away from a fixed plate 60 that is attached to the frame. A window 64 is disposed in the frame 52 between the end of the ram and the plate 60 for access to crimping tooling 70 contained within the frame. A typical precision contact terminal 66 of the type to be crimped by this hand tool 50 onto a multi-strand conductor 68, is shown in FIG. 4.

Figure 7:
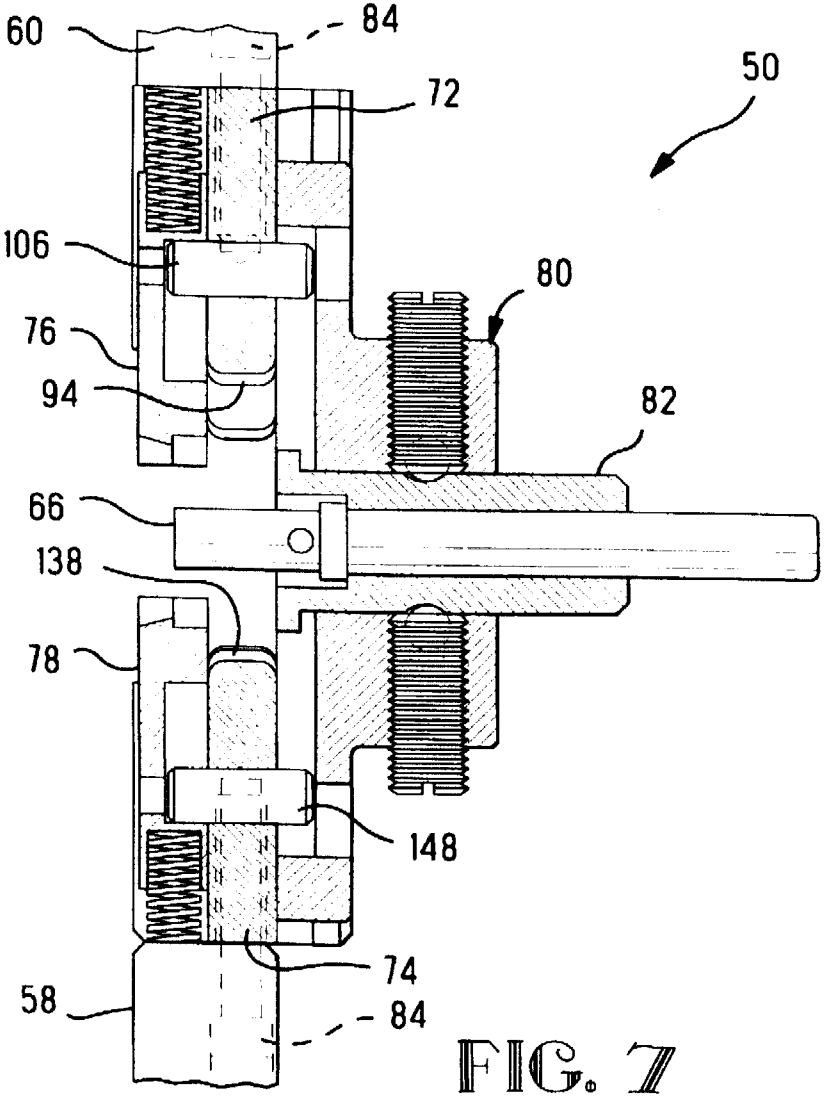
FIG. 7 is a cross-sectional view taken along the lines 7—7 in FIG. 6.
Figure 6:
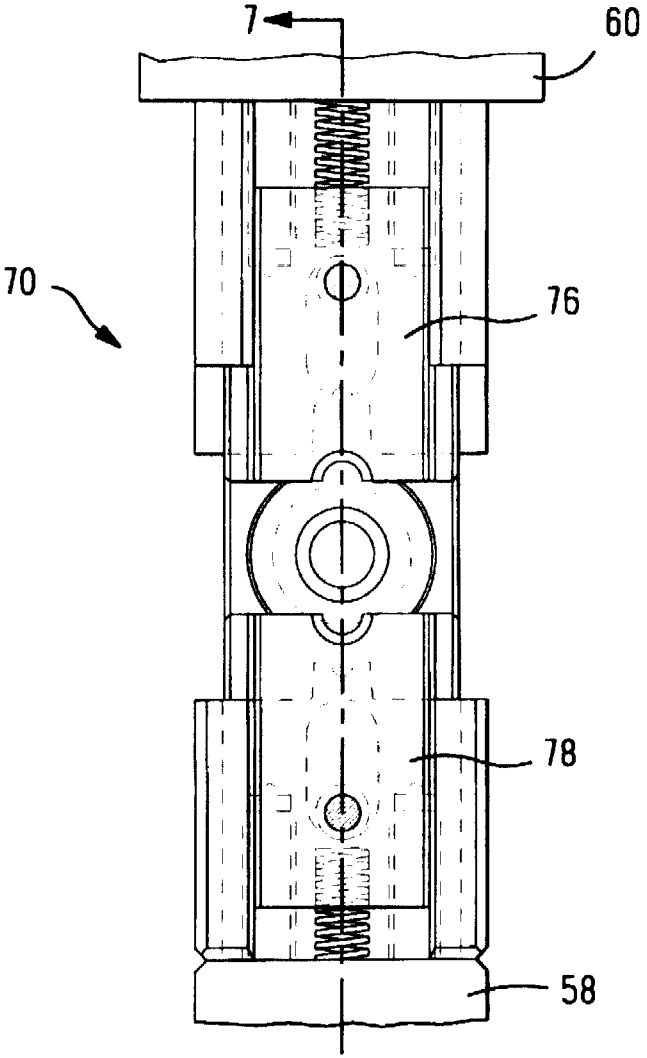
FIG. 6 is a front view of the crimping mechanism shown in FIG. 5.

As shown in FIGS. 6 and 7, the crimping tooling 70 consists of a crimper 72, an anvil 74, two opposed but identical terminal supports 76 and 78, and a self centering body 80 carrying a cylindrically shaped terminal holder 82. The crimper 72 is secured to the fixed plate 60 while the anvil 74 is secured to and carried by the ram 58, both being secured by any suitable means, such as screw fasteners 84.

Figure 10:
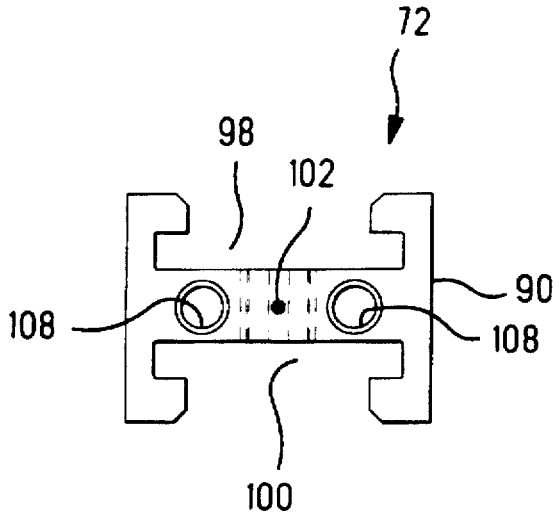
FIGS. 8, 9, and 10 are front, side, and top views of the crimping die shown in FIG. 7.
Figure 8:
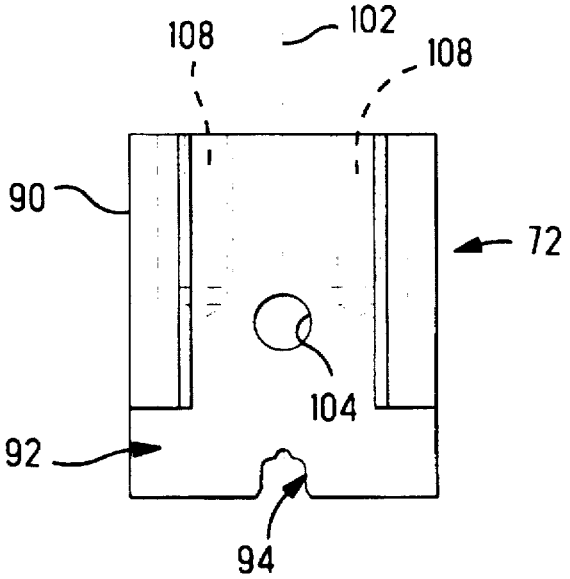
Figure 9:
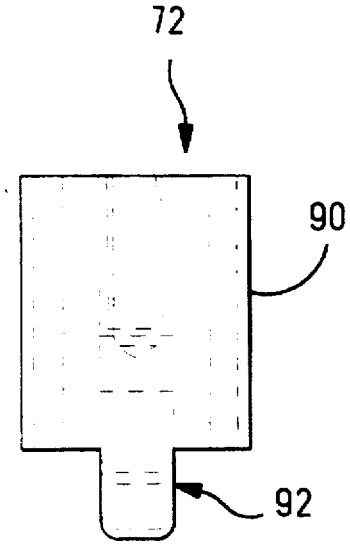

As shown in FIG. 8, 9, and 10, the crimper 72 includes a shank 90 and a crimping die 92 having a contoured surface 94 for crimping a terminal 66 in cooperation with the anvil 74. A pair of back to back T-shaped openings 98 and 100 are formed in the shank 90, as best seen in FIG. 10, centrally about an axis 102 that extends through the center of the contoured surface 94, as shown in FIG. 8. The surfaces of the T-shaped openings are parallel to the axis 102 and spaced so that the opening 98 will slidingly receive side flanges of the self centering body 80 and the other opening 100 will slidingly receive the terminal support 76, with a very small amount of lateral play in both cases. A hole 104 is formed through the shank 90 intersecting the axis 102 and perpendicular thereto, as best seen in FIG. 8. The hole 104 is a light press fit for a pin 106 that extends through the hole and into the two T-shaped openings 98 and 100, as shown in FIG. 7. A pair of threaded holes 108 are formed in the shank 90 on opposite sides of the axis 102 and parallel thereto, as shown in FIGS. 8 and 10. The holes 108 receive the screws 84 for securing the crimper 72 to the fixed plate 60.

Figure 11:
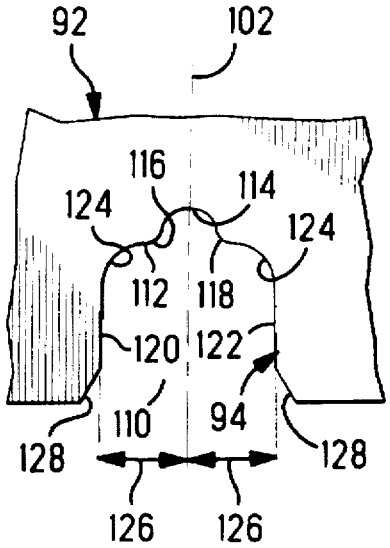
FIG. 11 is an enlarged view of a portion of the crimping die shown in FIG. 8.

The contoured surface 94, as best seen in FIG. 11, defines an opening 110 in the crimping die 92. The opening 110 includes a floor 112 having a relief recess 114 formed therein bisected by the axis 102. Two barrel engaging portions 116 and 118 are formed at the two junctures of the floor 112 and the recess 114. Each barrel engaging portion 116 and 118 is a convex arcuate surface, a generous radius in the present example, that smoothly connects the recess 114 and the floor 112. Importantly, the arcuate surfaces of the portions 116 and 118 are without any flat surfaces or sharp corners or edges that could interfere with smooth deformation of the barrel without over stressing the layer of plating on the surface of the barrel during crimping. The opening 110 includes two opposite side walls 120 and 122 which join the floor 112 in smooth radiuses 124 on opposite sides of the axis 102, as shown in FIG. 11. A lead in chamfer 128 is formed at the end of each of the side walls 120 and 122. The two side walls 120 and 122, in the present example, diverge away from the floor 112 at a angle 126 with the axis 102 of one degree. As will be explained below, it is important that this angle 126 be less that about three degrees, and preferable one degree or less.

Figure 12:
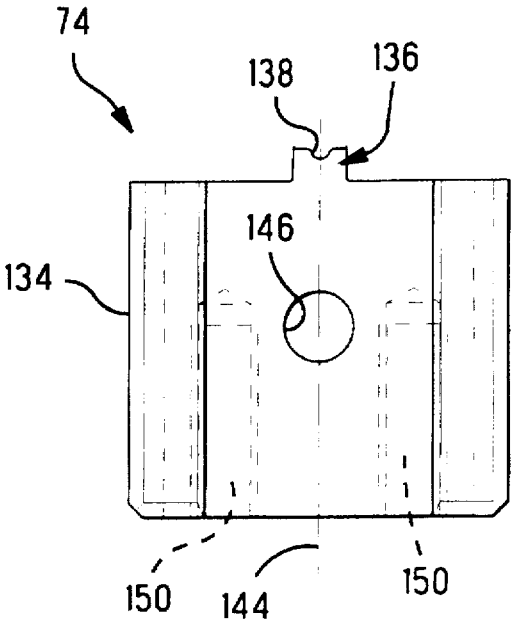
FIGS. 12, 13, and 14 are front, side, and bottom views of the crimping anvil shown in FIG. 11.
Figure 13:
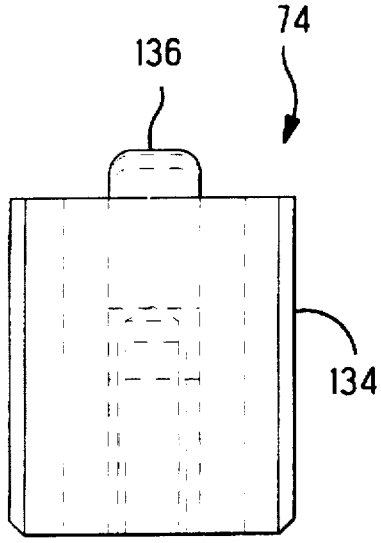
Figure 14:
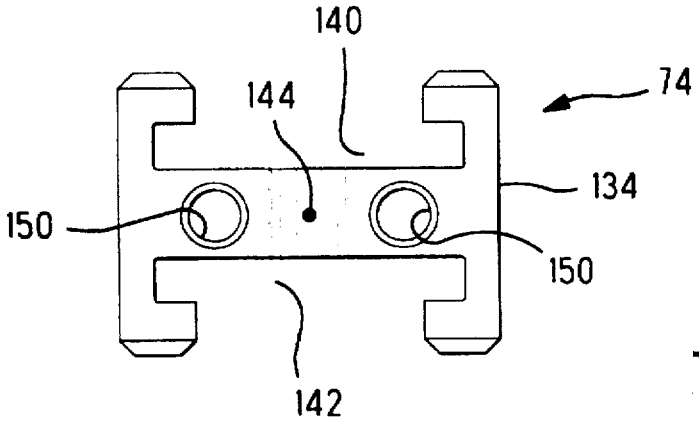

As shown in FIGS. 12, 13, and 14, the anvil 74 includes a shank 134 and a crimping anvil 136 having a contoured surface 138 for crimping the terminal 66 in cooperation with the crimper 72. A pair of back to back T-shaped openings 140 and 142 are formed in the shank 134, as best seen in FIG. 14, centrally about an axis 144 that extends through the center of the contoured surface 138, as shown in FIG. 12. The surfaces of the T-shaped openings are parallel to the axis 144 and spaced so that the opening 140 will slidingly receive the flanges of the self centering body 80 and the other opening 142 will slidingly receive the terminal support 78, with a very small amount of lateral play in both cases. A hole 146 is formed through the shank 134, intersecting the axis 144 and being perpendicular thereto, as best seen in FIG. 12. The hole 146 is a light press fit for a pin 148 that extends through the hole and into the two T-shaped openings 140 and 142, as shown in FIG. 7. A pair of threaded holes 150 are formed in the shank 134 on opposite sides of the axis 144 and parallel thereto, as shown in FIGS. 12 and 14. The holes 150 receive the screws 84 for securing the anvil 74 to the ram 58. The crimping anvil 136 is sized to closely mate with the crimping die 92 so that their respective contoured surfaces 138 and 94 will cooperate to crimp the terminal 66.

Figure 15:
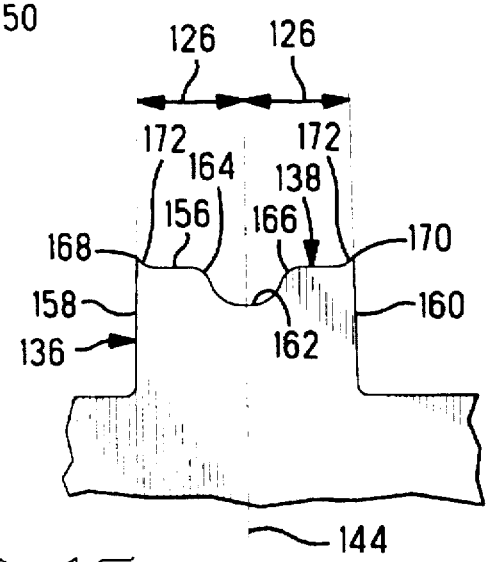
FIG. 15 is an enlarged view of a portion of the crimping anvil shown in FIG. 12.

The contoured surface 138, as best seen in FIG. 15, is formed on an end 156 of the crimping anvil 136. The crimping anvil 136 includes two opposite walls 158 and 160 that converge toward the end 156 at an angle to the axis 144 that is substantially similar to the angle 126 of the walls 120 and 122 of the crimper 72. The end 156 includes a relief recess 162 formed therein bisected by the axis 144. Two barrel engaging portions 164 and 166 are formed at the two junctures of the end 156 and the recess 162. Each barrel engaging portion 164 and 166 is a convex arcuate surface, a generous radius in the present example, that smoothly connects the recess 162 and the end 156. As with the barrel engaging portions 116 and 118, it is important that the arcuate surfaces of the portions 164 and 166 are without any flat surfaces or sharp corners or edges that could interfere with smooth deformation of the barrel without over stressing the layer of plating on the surface of the barrel during crimping. The end 156 terminates at each side wall 158 and 160 in somewhat sharp edges 168 and 170, respectively, that are upturned and extend outwardly, as viewed in FIG. 15, for a purpose that will be explained. A concave arcuate surface 172, a radius in the present example, smoothly blends the end 156 to the two edges 168 and 170 to allow a smooth flow of barrel material as the barrel is deformed during crimping.

Figure 1:
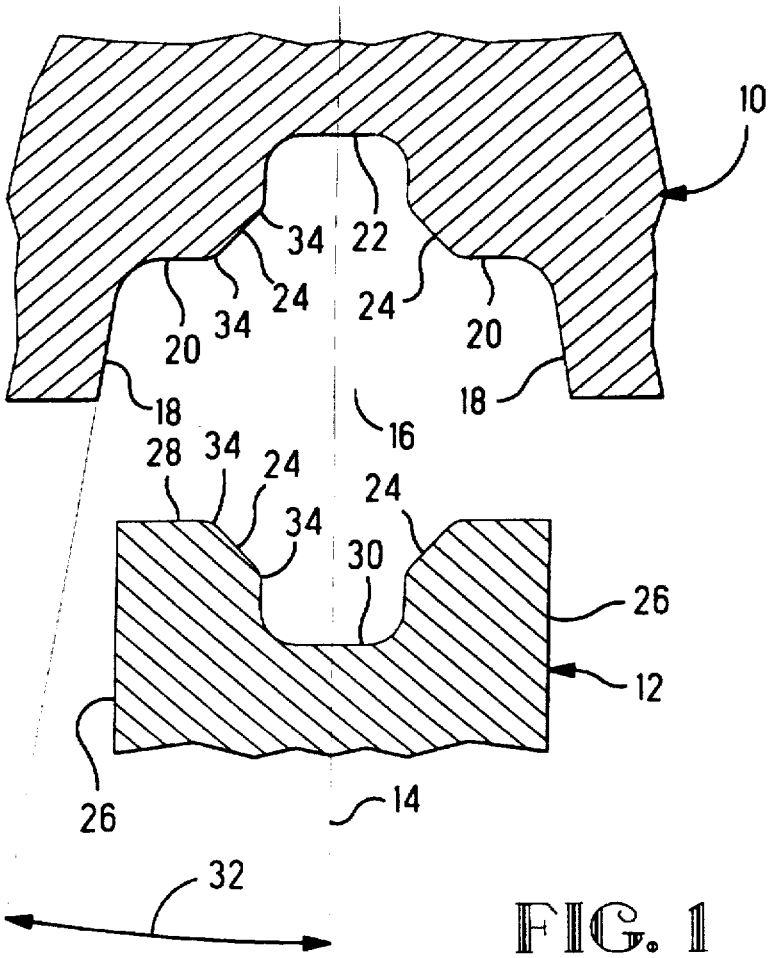
FIG. 1 Prior Art
FIG. 1 is a cross-sectional view of a portion of crimping tooling showing a prior art crimp configuration.
Figure 2:
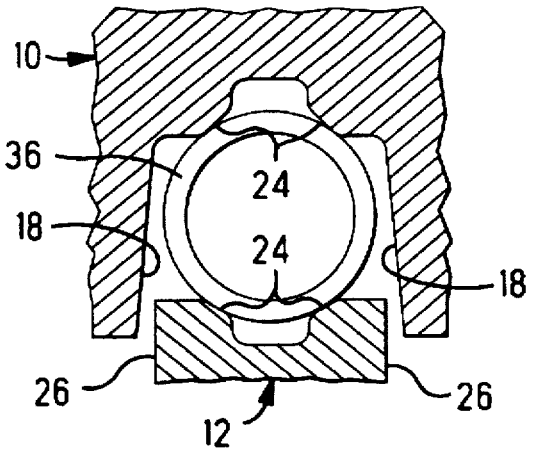
FIG. 2 Prior Art
FIGS. 2 and 3 are views similar to that of FIG. 1 showing two different stages of the crimping operation.
Figure 3:
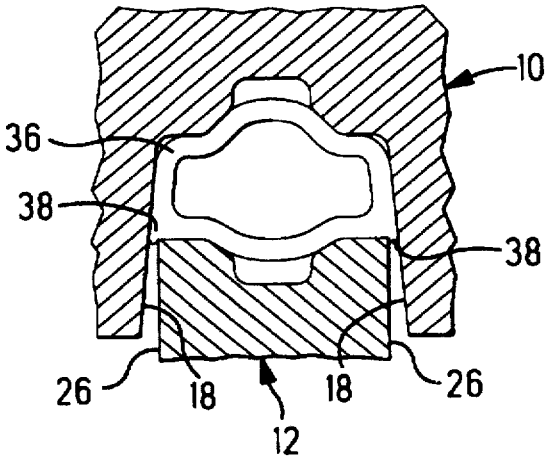
FIG. 3 Prior Art

The crimping anvil 136 is sized to be closely received within the opening 110 of the crimping die 92, during the crimping process, with little or no side to side clearance. That is, when the crimping anvil 136 is fully mated with the crimping die 92, the side walls 158 and 160 are in engagement with the side walls 120 and 122, respectively. As set forth above an angle 126 of three degrees or more results in burrs being formed in the gap between the crimping anvil and the opening of the crimping die, as shown at 36 in FIG. 3. Where the angle 126 is one degree, as in the present example shown in FIG. 16, and the crimping die depth 178 is 0.075 inch, the maximum clearance between the edges 170 of the crimping anvil 136 and the side walls 120 and 122 of the crimping die 92 is 0.0013 inch. This will be explored more fully in the following discussion of the operation of the crimping apparatus.

Figure 16:
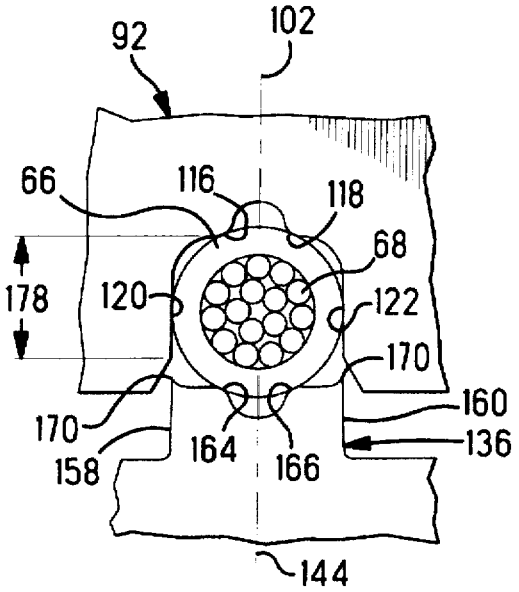
FIG. 16 is a schematic representation of portions of the crimping die and the crimping anvil showing a barrel of a terminal in position for crimping.

In operation, as shown in FIGS. 5, 6, 7, and 16 through 19, a terminal 66 to be crimped is inserted into position in the terminal holder 82, as shown in FIG. 7. The actuating lever 56 is then operated to start the ram 58 moving in the first direction toward the fixed plate 60. As the ram moves, the anvil 74 and terminal support 78 are moved upwardly and the terminal support 58 comes into engagement with the underside of the terminal 66. As movement of the ram continues, the contoured surface 94 of the anvil 74 engages the underside of the barrel of the terminal 66, and begins to move it upwardly along with the self centering body 60, which slides in the T-shaped opening 98 of the crimper 72. This movement continues until the upper edge of the terminal barrel engages the terminal support 76. At this point the operator momentarily discontinues operation of the lever 56 and inserts a conductor 68 through a wire guide formed in the terminal supports 76 and 78 and into seated engagement with the barrel of the terminal 66. After the conductor 68 is fully seated in the barrel, the lever 56 is again actuated to begin moving the ram 58 again in the first direction toward the fixed plate 60. As this movement continues, the barrel engaging portions 164 and 166 of the crimping anvil 136 and the barrel engaging portions 116 and 118 of the crimping die 92 engage the outer surface of the barrel of the terminal 66, as shown in FIG. 16.

Figure 17:
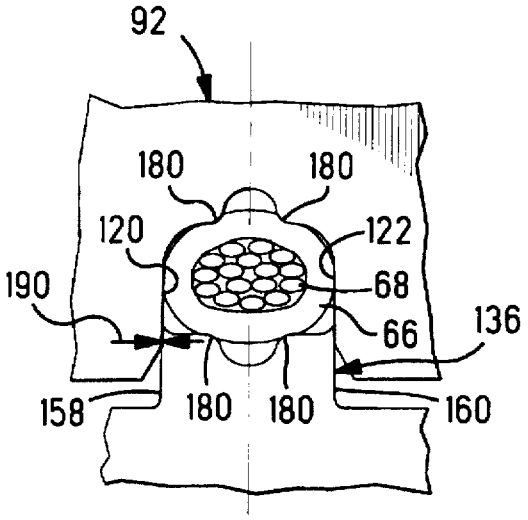
FIG. 17 is a view similar to that of FIG. 16 showing the barrel partially crimped.
Figure 18:
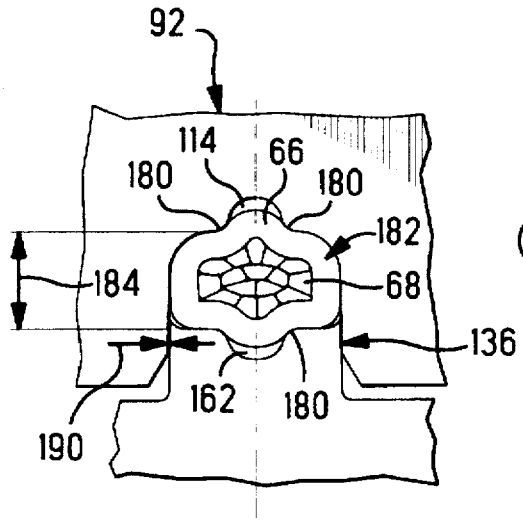
FIG. 18 is a view similar to that of FIG. 17 showing the barrel fully crimped to a particular crimp height.
Figure 19:
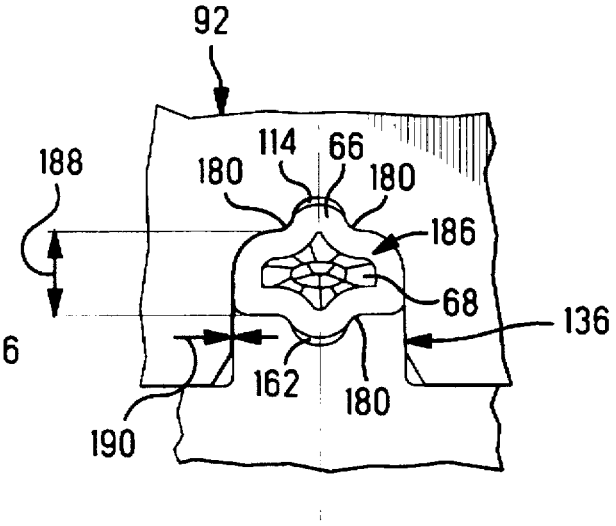
FIG. 19 is a view similar to that of FIG. 17 showing the barrel fully crimped to a smaller crimp height than that shown in FIG. 18.

As movement continues, the four barrel engaging portions 116, 118, 164, and 166 begin to form four indentations 180 at angularly spaced locations about the periphery of the barrel, as shown in FIG. 17. At this point in the crimping cycle the barrel of the terminal 66 has been deformed so that it is flat against the side walls 120 and 122 of the crimping die 136. The side walls 158 and 160 are spaced from their adjacent respective side walls 120 and 122 by a gap 190 of about 0.0006 inch. This is not sufficient space to permit the formation of a burr. As the ram 58 continues to move in the first direction the edges 170 and radiused surfaces 172 engage the barrel and begin to force it upwardly until the crimping anvil 136 is fully mated with the crimping die 92 thereby forming a crimped termination 182, as shown in FIG. 18. The crimped termination 182, in the present example, has a crimp height 184 of 0.045 inch.

Note that, while the crimping die 92 and the crimping anvil 136 are fully mated, for this particular terminal and wire size, there is still space remaining in the relief recesses 114 and 162. In the case where the terminal 66 or wire 68 is of smaller size, then the crimping anvil 136 will enter further into the opening 110 to reach its fully mated position thereby forming a crimped termination 186, shown in FIG. 19. The crimped termination 186, in the present example, has a crimp height 188 of 0.035 inch. It is important that the angle 126 be as small as possible, preferably that it be less than one degree so that the gap 190, when the crimping die 92 and crimping anvil 136 are in the partially mated position shown in FIG. 17, is about 0.0006 inch. This will produce a gap 190 of about 0.00017 at a crimp height 184 of 0.045 inch and a gap 190 of zero at a crimp height 184 of 0.035 inch. This will prevent the formation of a burr in these cases. This also permits the crimping die 92 and crimping anvil 136 to have the flexibility of crimping a variety of terminal and wire sizes by simply varying the crimp height 184, without the danger of forming a burr when the crimp height is relatively small. After the crimped termination 184 or 186 is formed the lever 56 is then released and the ram 58 moved in the second direction away from the fixed plate 60 to the starting position shown in FIG. 5. As the ram 58 is retracted, the pins 106 and 148 retract the two terminal supports 76 and 78 away from the crimped terminal along with the crimping die 72 and anvil 74.

While a manually powered hand tool 50, having a fixed plate and a reciprocating ram, is described herein to illustrate the teachings of the present invention, other types of hand tools, both manually operated and powered, as well as applicators that are operated in a press may be utilized. In hand tools or applicators having a fixed plate and a single ram, either the crimping die or the crimping anvil may be secured to and carried by the ram. However, hand tools and applicators having two opposing reciprocating rams or surfaces may also be advantageously utilized with the crimping mechanism of the present invention.

An important advantage of the present invention is that the terminal being crimped is self centered between the four barrel engaging portions 116, 118 of the crimping die and 164, 166 of the crimping anvil, thereby providing a precision four indent crimped termination. Additionally, the arcuate convex shape of the barrel engaging portions permits deformation of the barrel during the crimping process while, at the same time, controlling the flow of barrel material inwardly without cracking or otherwise damaging the delicate plating on the terminal. Further, the very small gap permitted between adjacent side walls of the mating die and anvil, along with the upturned edges of the anvil, combine to prevent the formation of a burr on the crimped barrel of the terminal.

What is claimed is:

1. A crimping apparatus for crimping a contact terminal having a wire receiving barrel to an electrical conductor within said barrel to produce a precision electrical termination, comprising;

(a) a crimping die having a first pair of barrel engaging portions spaced a fixed distance apart, said crimping die includes an opening having a floor and first and second opposed walls on opposite sides of said axis extending from said floor, each wall diverging away from said axis at a first angle of less than three degrees, (b) a crimping anvil having a second pair of barrel engaging portions spaced a fixed distance apart, each of which is opposed to and in alignment with a respective one of said barrel engaging portions of said first pair, one of said crimping die and said crimping anvil arranged to move in a first direction along an axis toward the other and into mated engagement therewith so that when a contact terminal is disposed between said crimping die and said crimping anvil said first and second pairs of barrel engaging portions engage said barrel of said contact terminal at four angularly spaced locations forming four indents thereby effecting electrical termination, wherein each said barrel engaging portion includes only a smooth convex surface for effecting said crimping engagement with said barrel.

2. The crimping apparatus according to claim 1 wherein said convex surfaces of said first pair of barrel engaging portions are on said floor on opposite sides of said axis.

3. The crimping apparatus according to claim 2 wherein said crimping anvil includes an end having third and fourth opposite walls, said third and fourth walls converging toward said end at an angle to said axis substantially equal to said first angle, said end sized to be closely received within said opening when said crimping anvil is in said mated engagement with said crimping die so that said third and fourth walls are in engagement with said first and second walls, respectively, with substantially no lateral space between adjacent walls.

4. The crimping apparatus according to claim 3 wherein said crimping die includes a first recess formed in said floor between said first pair of barrel engaging portions and said crimping anvil includes a second recess formed in said end between said second pair of barrel engaging portions, wherein during said crimping of said contact terminal, portions of said barrel are forced into said first and second recesses but do not fill said recesses.

5. The crimping apparatus according to claim 3 wherein said first angle is equal to or less than one degree.

6. The crimping apparatus according to claim 3 wherein said first, second, third, and fourth walls are mutually parallel.

7. The crimping apparatus according to claim 3 wherein said end includes first and second projections extending from opposite sides of said end adjacent said third and fourth walls, respectively, toward said floor when said crimping anvil is in said mated engagement with said crimping die, said projections arranged to direct flow of said barrel away from said walls during said crimping engagement, thereby preventing the formation of a burr.

8. The crimping apparatus according to claim 7 wherein each of said first and second projections includes a smooth concave surface terminating in a substantially sharp corner at its respective third and fourth wall.

9. A crimping apparatus for crimping a contact terminal having a wire receiving barrel to an electrical conductor within said barrel to produce an electrical termination, comprising;

(a) a crimping die having a first pair of barrel engaging portions spaced a fixed distance apart, wherein said crimping die includes an opening having a floor and first and second opposed walls on opposite sides of said axis extending from said floor, wherein said convex surfaces of said first pair of barrel engaging portions are on said floor on opposite sides of said axis;

(b) a crimping anvil having a second pair of barrel engaging portions spaced a fixed distance apart, each of which is opposed to and in alignment with a respective one of said barrel engaging portions of said first pair, wherein said crimping anvil includes an end having third and fourth opposite walls, said end sized to be closely received within said opening when said crimping anvil is in said mated engagement with said crimping die, wherein said end includes first and second projections extending from opposite sides of said end adjacent said third and fourth walls, respectively, toward said floor when said crimping anvil is in said mated engagement with said crimping die, said projections arranged to direct flow of said barrel away from said walls during said crimping engagement, thereby preventing the formation of a burr, one of said crimping die and said crimping anvil arranged to move in a first direction along an axis toward the other and into mated engagement therewith so that when a contact terminal is disposed between said crimping die and said crimping anvil said first and second pairs of barrel engaging portions engage said barrel of said contact terminal at four angularly spaced locations forming four indents thereby effecting said electrical termination.

10. The crimping apparatus according to claim 9 wherein each of said first and second projections includes a smooth concave surface terminating in a substantially sharp corner at its respective third and fourth wall.

11. The crimping apparatus according to claim 10 arranged so that when said crimping die and said crimping anvil are in said mated engagement said third and fourth walls are in engagement with said first and second walls, respectively, with substantially no lateral space between adjacent walls.

12. The crimping apparatus according to claim 11 wherein each said first and second walls extends from said floor and diverges away from said axis at a first angle of less than three degrees.

13. The crimping apparatus according to claim 12 wherein third and fourth walls converge toward said end at an angle to said axis substantially equal to said first angle.

14. A crimping apparatus for crimping a contact terminal having a wire receiving barrel to an electrical conductor within said barrel to produce a precision electrical termination, comprising;

(a) a crimping die having a first pair of barrel engaging portions spaced a fixed distance apart, said crimping die includes an opening having a floor and first and second opposed walls on opposite sides of said axis extending from said floor, each wall diverging away from said axis at a first angle of less than three degrees, (b) a crimping anvil having a second pair of barrel engaging portions spaced a fixed distance apart, each of which is opposed to and in alignment with a respective one of said barrel engaging portions of said first pair, one of said crimping die and said crimping anvil arranged to move in a first direction along an axis toward the other and into mated engagement therewith so that when a contact terminal is disposed between said crimping die and said crimping anvil said first and second pairs of barrel engaging portions engage said barrel of said contact terminal at four angularly spaced locations forming four indents thereby effecting electrical termination.

15. The crimping apparatus according to claim 14 wherein said crimping anvil includes an end having third and fourth opposite walls, said third and fourth walls converging toward said end at an angle to said axis substantially equal to said first angle, said end sized to be closely received within said opening when said crimping anvil is in said mated engagement with said crimping die so that said third and fourth walls are in engagement with said first and second walls, respectively, with substantially no lateral space between adjacent walls.

16. The crimping apparatus according to claim 15 wherein said crimping die includes a first recess formed in said floor between said first pair of barrel engaging portions and said crimping anvil includes a second recess formed in said end between said second pair of barrel engaging portions, wherein during said crimping of said contact terminal, portions of said barrel are forced into said first and second recesses but do not fill said recesses.

17. The crimping apparatus according to claim 15 wherein said first angle is equal to or less than one degree.

18. The crimping apparatus according to claim 15 wherein said first, second, third, and fourth walls are mutually parallel.

19. The crimping apparatus according to claim 15 wherein said end includes first and second projections extending from opposite sides of said end adjacent said third and fourth walls, respectively, toward said floor when said crimping anvil is in said mated engagement with said crimping die, said projections arranged to direct flow of said barrel away from said walls during said crimping engagement, thereby preventing the formation of a burr.

20. The crimping apparatus according to claim 19 wherein each of said first and second projections includes a smooth concave surface terminating in a substantially sharp corner at its respective third and fourth wall.

* * * * *